United States Patent [19]

Daenen et al.

[11] 4,372,526

Feb. 8, 1983

[54] ICE CUBE MAKING APPARATUS AND SERVING SYSTEM

[75] Inventors: Robert H. C. M. Daenen, Hekelgem, Belgium; Erik Herlow, Tikob, Denmark

[73] Assignee: Dart Industries, Inc., Northbrook, Ill.

[21] Appl. No.: 280,854

[22] Filed: Sep. 17, 1981

[51] Int. Cl.[3] ..... F25C 1/24

[52] U.S. Cl. ..... 249/119; 249/120; 249/126; 249/127; 249/129; 249/130

[58] Field of Search ..... 249/117, 119, 120, 121, 249/126, 127, 129, 130, 132, 139

[56] References Cited

U.S. PATENT DOCUMENTS

| | | | |
|---|---|---|---|
| 224,928 | 10/1872 | Wiley | D9/186 |
| 1,824,308 | 9/1931 | Storer . | |
| 1,869,914 | 12/1959 | Teague | D58/17 |
| 2,257,377 | 9/1941 | Haben | 249/121 X |
| 2,587,852 | 3/1952 | Jahn et al. | 249/130 |
| 2,606,586 | 8/1952 | Hill | 150/0.5 |
| 2,784,684 | 3/1957 | MacLean | 107/19 |
| 2,961,850 | 11/1960 | Tupper | 249/126 |
| 3,021,695 | 2/1962 | Voigtmann | 62/370 |
| 3,159,985 | 12/1964 | Keighley | 249/127 X |
| 3,197,058 | 7/1965 | Hale | 220/23.6 |
| 3,203,583 | 8/1965 | Amberg et al. | 220/102 |
| 3,307,739 | 3/1967 | Cloyd et al. | 220/97 |
| 3,412,572 | 11/1968 | Kesling | 62/344 |
| 3,443,785 | 5/1969 | Ewers | 249/127 X |
| 3,670,523 | 6/1972 | Fogt et al. | 249/126 X |
| 4,081,122 | 3/1978 | Hobson | 249/127 X |
| 4,091,953 | 5/1978 | Daenen | 220/23.86 |
| 4,148,457 | 4/1979 | Gurbin | 249/127 X |
| 4,162,780 | 7/1979 | Rankin | 249/126 X |

*Primary Examiner*—J. Howard Flint, Jr.
*Attorney, Agent, or Firm*—Jones & Askew

[57] ABSTRACT

An improved ice cube making and storing system including an ice cube tray, a container for storing and/or serving ice cubes, and a lid for the container. The ice cube tray includes a plurality of separate freezing compartments for forming ice cubes, and incorporates a liquid drain arrangement so that excess water may be removed from the freezing compartments before the tray is transferred to the freezer. The lid may be used as a support for the liquid-filled ice cube tray, to catch any liquid overflow or spillage during filling or transfer to the freezer. The ice cube tray fits directly onto the open end of the ice cube container, so that ice cubes are ejected directly into the container from the tray.

8 Claims, 7 Drawing Figures

ICE CUBE MAKING APPARATUS AND SERVING SYSTEM

FIELD OF THE INVENTION

This invention relates in general to apparatus for making and serving ice cubes, and relates in particular to an improved system including stackable ice cube trays, a container for receiving and storing ice cubes, and a lid which fits the container and which also forms a base for the trays.

BACKGROUND OF THE INVENTION

Although some homes may be equipped with automatic ice making equipment, ice cubes in most homes are made with individual ice cube trays placed in a freezer or the freezing compartment of a refrigerator. These trays are first filled with water, usually at the kitchen sink, and are then hand-carried to the refrigerator or freezer. The trays containing frozen ice cubes are later removed from the freezer, and the ice cubes are frequently extracted from the trays and placed in a suitable ice bucket or other container to await use.

Making ice cubes with conventional ice trays is, as most persons realize, an awkward and potentially messy experience. Ice cube trays are frequently filled with water nearly to overflowing, with the result that water in the trays is frequently sloshed or spilled during the trip from sink to refrigerator. Even if one succeeds in bringing the freshly-filled tray to the refrigerator without spilling, the person must then juggle the tray in one hand while opening the door to the freezer compartment with the other hand, an operation especially prone to spillage. Some sloshing or spillage frequently occurs as the freshly-filled tray is placed in the freezer compartment, causing the tray itself to become securely frozen to the floor of the freezer compartment or to adjacent ice cube trays.

Conventional ice cube trays, in addition to having the disadvantages noted above, have other known disadvantages. For example, conventional trays cannot easily be stacked one atop the other in the freezer, and so the trays must be placed side by side or on special shelves provided for that purpose in the freezer. Consequently, existing ice cube trays do not efficiently use the available volume of space within the freezer.

Moreover, after ice cubes are formed in conventional trays, it is frequently difficult to extract the ice cubes from the trays without dropping the individual cubes or fragments of ice released from the tray while extracting the ice cubes.

SUMMARY OF THE INVENTION

Accordingly, it is an object of the present invention to provide improved ice cube making apparatus.

It is another object of the present invention to provide ice cube making apparatus which eliminates or substantially reduces water spillage when loading and transporting the tray.

It is yet another object of the present invention to provide improved ice cube making trays which nest one above the other, so that several such trays nested together can be filled with water and then placed in a freezer without spillage.

It is a further object of the present invention to provide an improved ice cube making and serving system including at least one ice cube making tray, a container for receiving and storing ice cubes, and a container lid which can function as a base to receive liquid overflow from the freshly-filled ice cube trays.

Other objects, features and advantages of the present invention will become apparent upon reading and understanding the following specification, when taken in conjunction with the accompanying drawing and the appended claims.

Stated in general terms, ice cube making apparatus according to the present invention includes at least one stackable tray having a plurality of freezing compartments each receiving a certain amount of liquid. The tray includes one or more liquid drains located at adjacent the freezing compartments, so that excess liquid may be drained from the freezing compartments in an orderly manner. Each freezing compartment thus is filled to a level below the top, avoiding freezing together of the separate ice cubes. If the ice making tray is nested above a like tray, this drained excess liquid enters the freezing compartments of the subjacent apparatus. If no ice cube making tray is nested below, a lid forming part of the system can catch the drainage. This lid fits beneath the ice cube making tray while being carried from the point of filling with water, to the freezer.

Stated somewhat more specifically, the ice cube making tray of the present invention is filled with water and carried to the freezer while mounted on a receptacle intended to catch any spilled liquid. The freezing compartments of each ice cube tray are collectively surrounded by a rim to prevent spills from overflowing the apparatus, so that excess liquid or spillage instead flows through the drain in an orderly manner and is collected in the container.

The present system includes an ice storage container for receiving the ice cubes directly from the ice cube making apparatus, and a lid for the container. The ice cube trays are configured to fit directed onto the opened container when the tray is inverted, so that the ice cubes may be ejected from the tray directly into the container without dropping or spilling the cubes. The underside of each ice cube tray is also configured to fit into the ice cube container lid when the lid is inverted. The inverted lid thus serves as the liquid overflow collector while the trays are filled and carried to the freezer, and the inverted lid may also be used to support a stacked array of several ice cube trays in the freezer. The trays preferably are of generally square or rectangular shape, for more compact storage and more efficient utilization of space within the freezer.

DESCRIPTION OF PREFERRED EMBODIMENT

Figure 1:
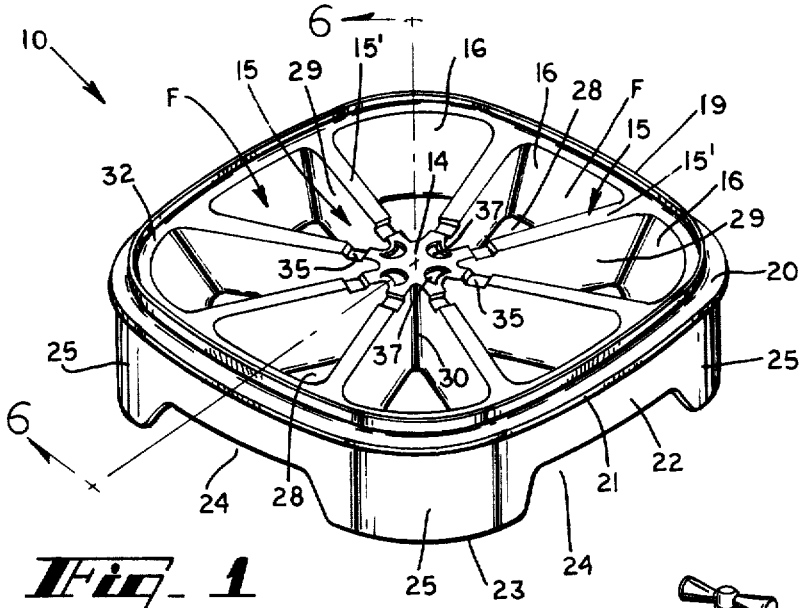
FIG. 1 is a pictorial view showing a preferred embodiment of ice cube making tray according to the present invention.
Figure 2:
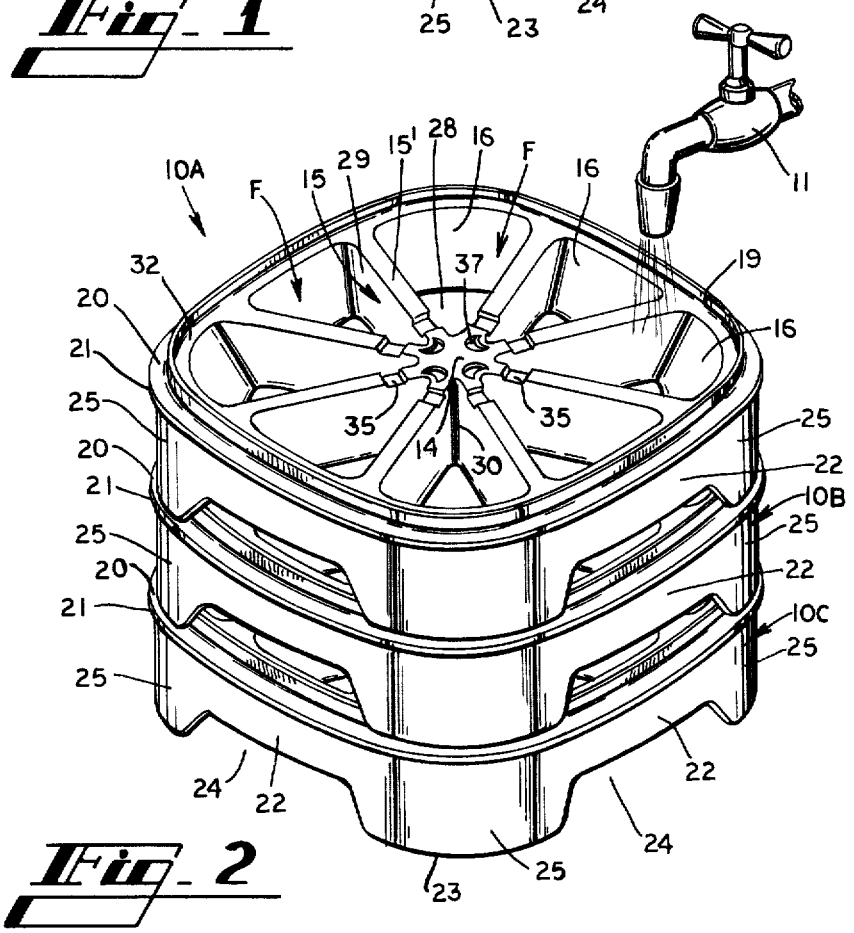
FIG. 2 is a pictorial view showing a plurality of trays as in FIG. 1, nestingly stacked with the uppermost tray being filled with water.

Turning first to FIG. 1, there is shown generally at 10 an ice cube tray according to the disclosed embodiment of the present invention. The tray 10 is generally rectangular in overall plan view, and the tray is preferably formed as a unitary object made of suitable plastic material such as polyethylene or the like. The ice cube tray 10 is nestable on top of other like trays, as described below in further detail. FIG. 2 shows three such trays 10A, 10B, and 10C nested on each other, with the topmost tray 10A being filled with water from the faucet 11.

Figure 6:
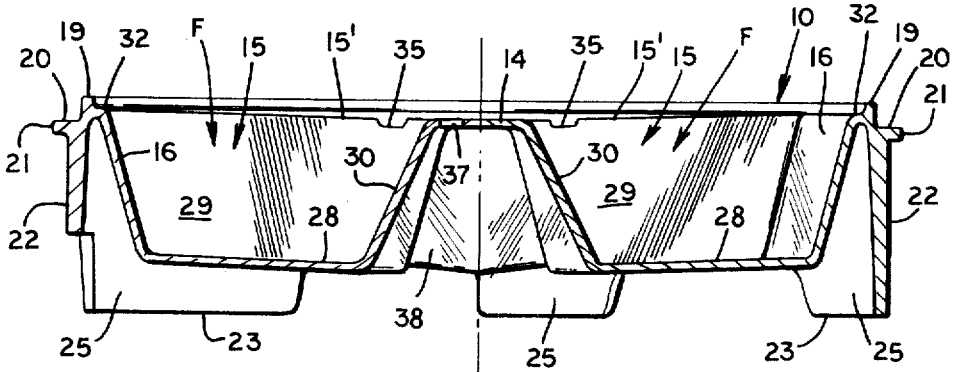
FIG. 6 is a section view taken along line 6—6 of FIG. 1, showing details of the ice cube tray.
Figure 5:
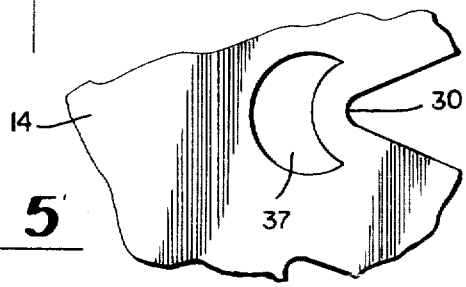
FIG. 5 is a fragmentary detailed section, showing one of the drain openings.

Turning to FIGS. 1 and 6, each ice cube tray 10 defines a plurality of separate freezing compartments F disposed in radial relation surrounding the centrally-located center wall 14. The freezing compartments F are approximately the shape of a slice of pie, and although all freezing compartments are not identical in interior shape. Each freezing compartment F is separated from adjacent compartments by the compartment dividers 15, described below in greater detail, extending radially outwardly from the center wall 14 to the tapered outer walls 16 of the freezing compartments.

The several freezing compartments F collectively are surrounded by the rim 19, which extends upwardly in a generally vertical direction from the ledge or periphery 20 lying immediately outside the rim. The outermost extent of the ledge 20 forms a flange 21, best seen in FIG. 6, which protrudes outwardly a short distance from the sides 22 of the tray 10. Each side 22 extends downwardly from the flange 21 to a lower edge 23, which supports the tray 10 on a suitable subjacent surface such as a lower nested tray 10B (FIG. 2) or another appropriate support surface. An intermediate portion of each side 22 is cut away to form the recesses 24, so that the unrecessed portions of the sides form the feet 25 at the four corners of the tray 10.

Returning to FIG. 6, it can be seen that each freezing compartment F is defined by the outer wall 16, a bottom wall 28, and the two side walls 29 each comprising half of a divider 15 between adjacent freezing compartments. The inner wall 30, FIG. 6, actually represents the convergence of the two side walls 29 for each freezing compartment F. The walls forming each freezing compartment F are tapered upwardly from the bottom 28 of the compartment to assist in ejecting the ice cubes formed in the compartment.

The structure defining the freezing compartments F, including the center wall 14 about which the freezing compartments are disposed, is supported from the sides 22 of the tray 10 by the web 32 interconnecting the sides 22 with the outer walls 16 of the freezing compartments. The bottom walls 28 of the freezing compartments are maintained in elevated relation to the lower edge 23 of the sides 22, and are elevated above a flat support surface on which the ice cube tray 10 rests. Accordingly, it is seen that the freezing compartments F are mounted cantilever-fashion extending inwardly from the sides 22 of the tray 10; the overall construction of the tray, and particularly the thickness of the web 32 interconnecting the freezing compartment structure with the surrounding side structure, is sufficiently resilient to permit a small degree of elastic bending about the web 32, in response to manually-applied force applied to the vicinity of the center wall 14, which pitches the freezing compartment structure upwardly or downwardly to some extent for purposes which becomes more apparent below. It can also be seen from FIG. 6 that the freezing compartments F, including the bottom walls 28 and the top 15' of each divider 15, have a slight downward pitch extending from the rim 19 to the center wall 14, even in the absence of external force applied to the center wall 14.

Channels 35 interconnecting adjacent freezing compartments F are formed as a depression in the top 15' of each divider 15. The channels 35 are located near the interior ends of the dividers 15, adjacent the center wall 14, and these channels permit liquid cross-flow between the several freezing compartments F once a particular freezing compartment is filled up to the bottom of the channel. The channels 35 allow water to escape from a particular freezing compartment before the compartment is filled up to the very top 15' of the divider, thereby avoiding freezing together of ice in adjacent freezing compartments.

Formed in the center wall 14 are a number of drain holes 37 which extend through the center wall into communication with the open region 38 below that wall. The individual drain holes 37 are symmetrically positioned between the inner walls 30 of the freezing compartments F and the geometric center of the center wall 14; four separate drain holes are provided in the disclosed embodiment, although that number is not considered critical and a greater or lesser number can alternatively be provided.

It will be recalled that the web 32 is sufficiently elastic to permit the structure forming the freezing compartments F to be tipped or pitched, in response to manual force applied to the center wall 14. Considering the case where the ice cube tray 10 is filled with water, as from the faucet 11 of FIG. 2, the water level in each freezing compartment is equalized by cross-flow through the several channels 35 formed in the dividers 15. The person filling the tray 10 now presses downwardly on the center wall 14 of the tray, causing the freezing compartments F to pitch downwardly. This downward deformation of the freezing compartments allows excess water to leave the compartments by gravity and flow through the drain holes 37 to a location below the tray 10. When force is released from the center wall 14, the freezing compartments F elastically return to their initial nondeformed position. However, the level of water remaining in each freezing compartment is now below the edges of the individual compartments, due to the previous step of draining excess water through the holes 37. Each ice cube tray 10 may thus be rapidly filled with water without worrying about whether the individual freezing compartments are being uniformly filled. The channels 35 permit the water level in each freezing compartment to equalize automatically, and the rim 19 surrounding the freezing compartments retains the overfill at this stage. Following this rapid filling, the excess water is easily removed from the freezing compartments F through the drain holes 37 simply by depressing the center wall 14 as described above.

Figure 3:
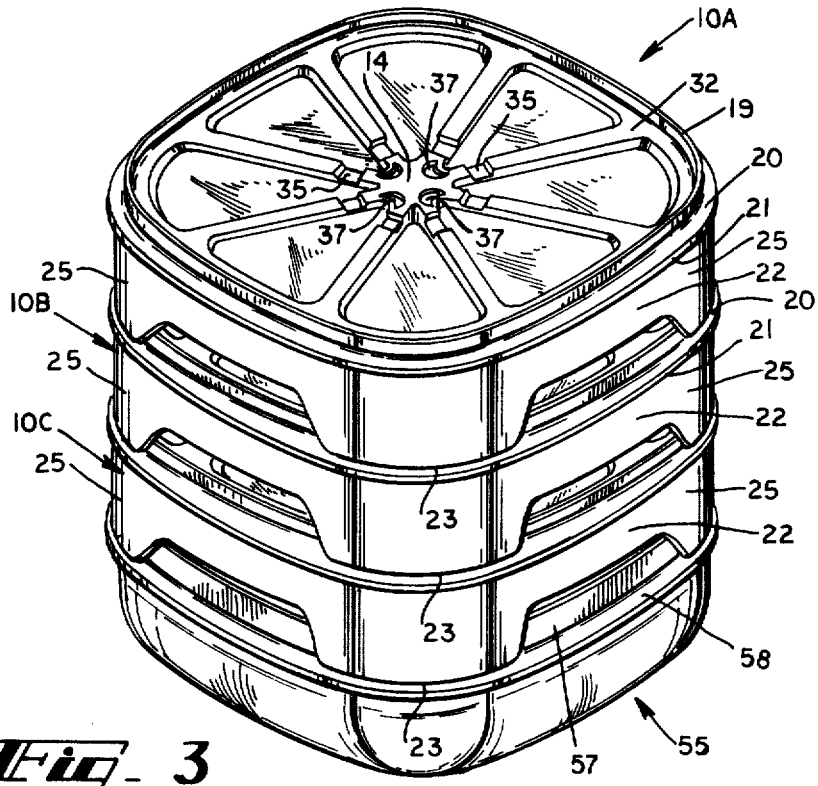
FIG. 3 is a pictorial view showing the nested trays as in FIG. 2, supported on top of the inverted container lid according to the preferred embodiment.

Due to the design of the ice cube tray 10, a nested stack of several such trays can be filled with water as illustrated in FIG. 2. Water from the faucet 11 initially fills the freezing compartments in the top tray 10A, and the overflow from that tray flows through the drain holes to fill the next tray 10B, and so on until all trays in the stack are filled. Overflow from the bottom tray runs into the sink below the faucet 11. The stacked trays are then fitted into the inverted lid 55 as shown in FIG. 3 and explained below, to avoid spilling the water when carrying the stacked trays to the freezer.

Figure 4:
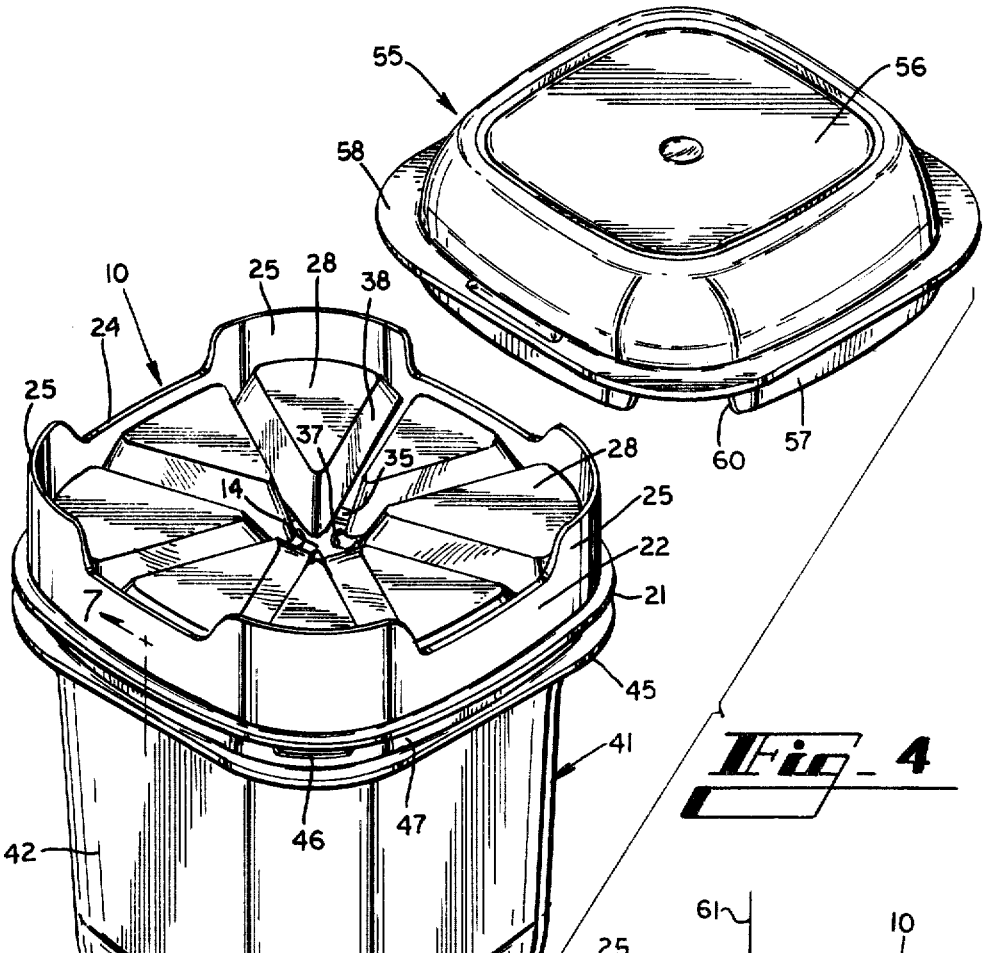
FIG. 4 is a pictorial view showing the ice cube making tray of FIG. 1, inverted and disposed on an ice cube storing container according to the preferred embodiment.
Figure 7:
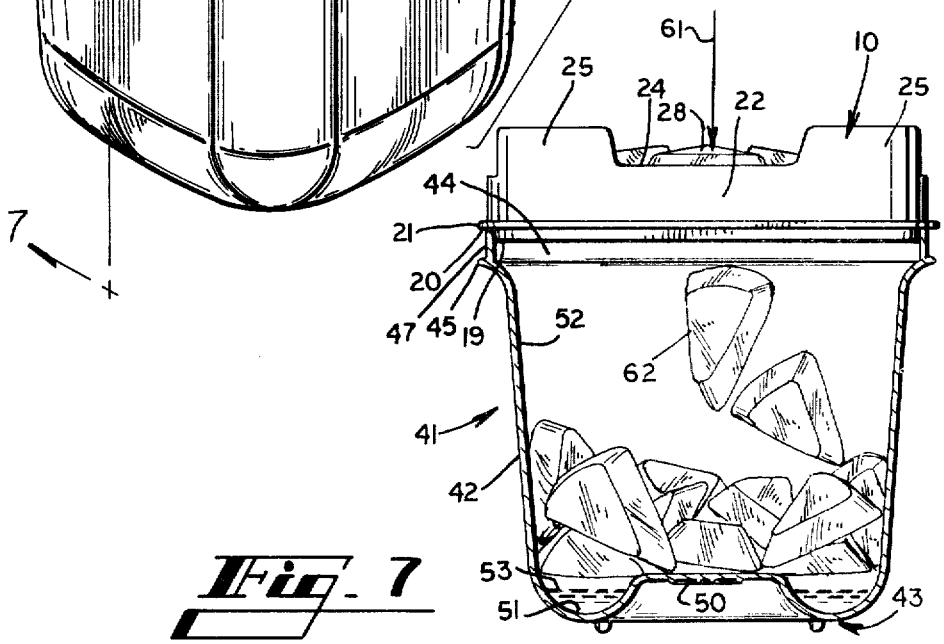
FIG. 7 is a section view taken along line 7—7 of FIG. 4.

The disclosed embodiment 41 of the ice cube storing and serving container forming part of the present invention is shown in FIGS. 4 and 7. This container is particularly configured to receive and hold a quantity of ice cubes made in the ice cube tray 10, although the container 41 obviously can be used to store ice cubes from any source. The container 41 can be used to store ice cubes in the freezer for future use, and can also be used outside the freezer to serve ice cubes.

The container 41, which may be rectangular in shape, includes the four sides 42 extending upwardly from the bottom 43 of the container. The open top 44 of the container is surrounded by a rim 45 which protrudes outwardly from the sides 42, a short distance below the top. The sides of the container 41 thus extend a short distance above the rim 45 to form the flange 47, and a cut-out portion 46 is provided in the flange at one corner of the container for a purpose described below.

The bottom 43 of the container 41, as best seen in FIG. 7, includes a central portion 50 raised upwardly a short distance from the channel 51, surrounding the raised central portion above that periphery of the container interior. The channel 51 provides a trough to collect water 53 from melted ice and condensation forming on the inside surface 52 of the container, while the ice cubes at the bottom of the container rest on the raised central portion 50 separated from the melt water.

An embodiment of lid 55 forming part of the present system is shown in FIG. 4, removed from the container 41 during an ice cube dumping operation as described below. The lid 55 includes a substantially flat top surface 56, and an open lower rim 57 configured to fit inside the open top 44 of the ice cube container 41. A ledge 58 a short distance up from the rim 57 projects outwardly from the outside of the lid 55, and completely surrounds the lid. This ledge 58 contacts the upper edge of the container top 44 when the lid is placed on the container, thereby limiting inward movement of the lid. When the lid 55 is in place on the container 41, the ledge 58 of the lid remains spaced apart from the rim 45 of the container, so that the ledge is easily grasped to remove the lid when desired.

A portion of the rim 57 on the lid 55 is cut-out as shown at 60, and the location of this cut-out portion mates with the cut-out 46 on the flange 47 of the container 41, when the lid is properly positioned on the container. The mating cut-outs 46 and 60 of the container thus provide an opening to pour accumulated melt water from the container from time to time. This may be accomplished simply by inverting the closed container 41 while holding the lid 55 in place by grasping the ledge 58 and the rim 45. Accumulated melt water pours out the opening provided by the aligned cut-outs, while the lid remains in place to keep the ice cubes from falling out. Once the melt water is poured, the container 41 is returned to the upright position.

The lid 55 performs a useful function in conjunction with one or more ice cube trays 10, in addition to performing its above-described function as a lid for closing the container 41. Referring to FIG. 3, it is seen that the lid 55 is inverted with the flat top surface 56 facing downwardly. The rim 57 of the lid 55 is configured to receive the underside of an ice cube tray 10, namely, tray 10C of the plural nested trays 10A–10C. The feet 25 of the ice cube tray 10C fit on the outside of the rim 57 of the lid, so that the lower edge 23 of the tray rests on the ledge 58 of the lid.

Using the inverted lid 55 as a base for one or more ice cube trays 10, as shown in FIG. 3, is useful is several ways. For instance, the inverted lid may be in place while the trays are filled with water, so that excess water flowing through the drain holes 37 in the ice cube tray(s) is collected in the lid instead of dripping from the bottom-most ice cube tray. Additionally, the inverted lid is particularly useful as a base beneath the lowermost ice cube tray when the liquid-filled trays are being transferred to the freezer. Even though excess water has been removed from the trays by flowing through the drain holes 37 as described above, some further water may nonetheless enter the drain holes due to sloshing or uneven carrying, despite careful attention of the person carrying the ice cube tray to the freezer. This spill water simply flows through the drain holes 37 and collects in the inverted lid, with the arrangement shown in FIG. 3. Once the freezer is reached, the inverted lid 55 may simply be removed from the lower-most nested tray 10C, and the entire nested array of trays placed within the freezer. Alternatively, the inverted lid may be placed in the freezer with the nested trays remaining thereon, inasmuch as the flat top surface 56 of the inverted lid provides a stable support for the nested trays within the freezer.

Once the water within the freezing compartments F has solidly frozen into ice, the tray(s) may be removed from the freezer and the contents of each tray separately ejected into the container 41. This is accomplished as shown in FIG. 4, by inverting each ice cube tray 10 and placing the tray on the open top 44 of the container 41. The rim 19 of the inverted ice cube tray fits within the flange 47 of the open container as best seen in FIG. 7, and the ledge 20 of the tray engages the upper edge of the container top 44 to maintain the tray 10 in place.

Once the ice cube tray 10 is positioned as shown in FIGS. 4 and 7, manual downward force is applied to the inverted tray as shown by the arrow 61, FIG. 4. This application of force causes the freezing compartments F to flex slightly, ejecting the ice cubes 62 from the freezing compartments F. The outwardly-diverging shape of each freezing compartment assists in ejecting the ice cubes in response to this flexing of the tray. The ejected ice cubes fall directly into the container 41. Because the ice cube tray 10 actually fits onto the open top 44 of the container as the cubes are ejected, the cubes cannot possibly fall on the floor or otherwise miss entering the container. After the ice cubes from each tray are ejected into the container 41 in the foregoing manner, the container may be closed by the lid 55. The trays may again be filled and returned to the freezer to repeat the foregoing cycle of operation.

It should be understood that the foregoing describes but a single embodiment of the present invention and that numerous modifications and alterations may be made therein without departing from the spirit or scope of the invention as set forth in the following claims.

We claim:

1. Ice cube making apparatus comprising: means having an outer periphery and defining within said periphery a plurality of freezing compartments each capable of holding a certain amount of liquid; and drain means located on said first-mentioned means to receive the gravity flow of liquid supplied to said freezing compartments in excess of said certain amount, and including an opening within said periphery so that the excess liquid drains to a location below said freezing compartments.

2. Apparatus as in claim 1, further comprising:

means defining a rim surrounding said plural freezing compartments, said rim being higher than said drain means so that said excess liquid is retained within said rim to flow through said drain means.

3. Apparatus as in claim 2, wherein said drain means is at a location pitched downwardly from the location of said rim, so as to facilitate said gravity flow of excess liquid to the drain means.

4. Apparatus as in claim 2, further comprising channel means interconnecting said freezing compartments to equalize the level of said excess liquid within each freezing compartment, so that the volume of liquid remaining in each freezing compartment to form ice is substantially uniform.

5. Apparatus as in claim 1, further comprising:

means for supporting said plural freezing compartments in spaced apart relation above a surface on which said apparatus rests:

said support means being sufficiently resilient to permit said freezing compartments to deform in response to manually-applied force, thereby assisting the flow of excess liquid by gravity to said drain means; and said support means being sufficiently elastic to return said freezing compartments to a nondeformed position, when said manual force is removed.

6. Ice cube making tray comprising:

means defining a support including a peripheral portion extending around and defining an interior region;

said support means including a lower surface operative to rest on a surface beneath said ice cube making tray;

means carried by said support means and defining a plurality of freezing compartments in said interior region, said freezing compartments having bottom surfaces elevated with respect to said lower surface of said support means;

means on said support means configured to receive and engage the lower surface of another said ice cube making tray nested above said support means, so that at least two of said ice cube making trays can be stacked one above the other with the bottom surface of freezing compartments in the upper stacked tray being maintained out of contact with the freezing compartments of the lower stacked tray; and drain means associated with said freezing compartments, said drain means positioned to receive liquid supplied to said freezing compartments in excess of a certain volume of liquid, so that the excess liquid enters the drain means and flows to a location below said freezing compartments.

7. Apparatus as in claim 6, wherein:

said drain means is located in said interior region, and said freezing compartments are disposed between said drain means and the periphery surrounding said interior region;

said freezing compartments are carried by said support means with sufficient elasticity to deformably pitch downwardly from said periphery to said centrally located drain means, in response to manually applied force, so as to aid gravity flow of excess liquid to said drain means; and said freezing compartments are elastically returnable to a nondeformed attitude when said manual force is removed.

8. Ice cube making and serving system comprising in combination:

(A) ice cube making tray comprising means defining a support with a peripheral portion extending around and defining an interior region;

said support means including a lower portion operative to rest on a surface beneath said tray;

means carried by said support means and defining a plurality of freezing compartments in said interior region, said freezing compartments having bottom surfaces elevated with respect to said lower portion of said support means; and means on an upper portion of said support means configured to receive and engage the lower portion of another said ice cube making tray nested above said support means, so that at least two said trays can be stacked one above the other with the bottom surface of freezing compartments in the upper stacked tray being maintained out of contact with liquid in the freezing compartments of the lower stacked tray;

(B) an ice storage container for receiving ice cubes formed in the storage compartments of said making apparatus;

said storage container comprising a bottom wall and side walls, and having an open upper end for removably receiving a lid;

said open end configured to receive and nestingly engage said upper portion of said support means on said ice cube making tray when inverted, so that the tray containing ice cubes can be inverted and nestingly engaged with said open upper end for ejecting ice cubes directly into said container without possible spillage; and (C) a lid detachably covering said container;

said lid comprising an under side configured to removably engage and close said open end of said storage container, and also configured to receive and nestingly engage said lower portion of said ice cube making tray when said lid is detached from said container and inverted; and said lid having a top comprising a substantially flat region providing a stable support for the lid when inverted on a horizontal surface, so that an ice cube making apparatus nests into the inverted lid in spaced apart relation above the inverted lid when engaged on said lower portion of the inverted lid;

the inverted lid including means providing a receptacle to receive and retain excess liquid draining from the one or more ice cube trays nested above the inverted lid.

* * * * *